US012082732B2

(12) United States Patent
Scanlon et al.

(10) Patent No.: US 12,082,732 B2
(45) Date of Patent: Sep. 10, 2024

(54) ADJUSTABLE TELESCOPING TENSION RODS

(71) Applicant: Decolin Inc., Montreal (CA)

(72) Inventors: Benjamin Scanlon, Philadelphia, PA (US); Adam T. Emenecker, Blackwood, NJ (US); David M. Baines, Bedford, NY (US)

(73) Assignee: Decolin Inc., Montreal (CA)

( * ) Notice: Subject to any disclaimer, the term of this patent is extended or adjusted under 35 U.S.C. 154(b) by 68 days.

(21) Appl. No.: 17/534,857

(22) Filed: Nov. 24, 2021

(65) Prior Publication Data

US 2022/0160158 A1 May 26, 2022

Related U.S. Application Data

(60) Provisional application No. 63/118,455, filed on Nov. 25, 2020.

(51) Int. Cl.
*A47H 1/022* (2006.01)
*A47H 1/102* (2006.01)

(52) U.S. Cl.
CPC ..... *A47H 1/022* (2013.01); *A47H 1/102* (2013.01)

(58) Field of Classification Search
CPC . A47H 1/022; A47H 1/102; A47H 2001/0215
See application file for complete search history.

(56) References Cited

U.S. PATENT DOCUMENTS 1,679,881 A * 8/1928 Simpson ..... A47H 1/022 211/105.4
2,947,556 A * 8/1960 Wenger ..... F16B 7/1463 248/161
4,585,367 A 4/1986 Gall
6,862,776 B2 * 3/2005 Chen ..... F16B 7/1463 403/109.5
8,215,863 B2 * 7/2012 Sohn ..... F16B 7/1463 403/109.5
8,479,932 B2 * 7/2013 Carney ..... A47H 1/022 403/109.5
8,505,129 B2 * 8/2013 Parker ..... A47H 1/022 248/200.1
8,505,749 B2 * 8/2013 Trettin ..... A47H 1/022 211/105.6

(Continued)

FOREIGN PATENT DOCUMENTS

CH 625601 A5 * 9/1981
DE 2053934 C2 * 8/1982

(Continued)

OTHER PUBLICATIONS

International Search Report dated Jun. 2, 2022 for PCT/CA2021/051674.

*Primary Examiner* — Stanton L Krycinski
(74) *Attorney, Agent, or Firm* — Alan G. Towner; Leech Tishman Fuscaldo & Lampl

(57) ABSTRACT

Adjustable tension rods with spring-biased tension lock assemblies are disclosed. The tension rods comprise at least one outer tube section and at least one inner tube section that are spring-biased with respect to each other by means of the tension lock assembly. The outer tube and/or inner tube may include a single tube section, or may include multiple tube sections that may be assembled together.

16 Claims, 10 Drawing Sheets

(56) References Cited

U.S. PATENT DOCUMENTS 8,827,587 B2 * 9/2014 Didehvar ..... F16B 7/06 248/265
8,851,305 B2 * 10/2014 Didehvar ..... F16B 7/06 248/354.3
8,851,435 B1 * 10/2014 Bastien ..... A47H 1/022 248/200.1
8,869,999 B2 10/2014 Lindo et al.
8,925,747 B1 * 1/2015 Hanley ..... A47H 1/022 211/105.6
8,960,456 B2 * 2/2015 Didehvar ..... A47K 3/38 403/109.5
9,107,495 B2 8/2015 Lindo et al.
9,107,496 B2 8/2015 Lindo et al.
9,271,592 B2 * 3/2016 Didehvar ..... A47H 1/142
9,388,837 B1 * 7/2016 Hanley ..... F16B 7/1463
10,047,787 B2 * 8/2018 Cheng ..... F16B 7/182
10,426,287 B1 * 10/2019 Tsai ..... A47H 1/022
10,844,890 B2 * 11/2020 Daniels ..... F16B 7/1445
10,995,786 B2 * 5/2021 Didehvar ..... F16B 7/025
11,454,267 B2 * 9/2022 Daniels ..... F16B 7/1445
2010/0310306 A1 * 12/2010 Wright ..... B25G 1/04 403/109.1
2010/0316438 A1 * 12/2010 Sohn ..... A45B 9/00 403/109.1
2011/0284484 A1 * 11/2011 Lin ..... A47B 96/1425 211/207
2012/0005823 A1 1/2012 Baines
2012/0217215 A1 * 8/2012 Emery ..... A47K 3/281 24/570
2012/0285914 A1 * 11/2012 Carney ..... A47H 1/022 211/123
2013/0112639 A1 5/2013 Baines
2013/0334156 A1 12/2013 Baines
2014/0166603 A1 6/2014 Baines
2014/0263123 A1 * 9/2014 Ford ..... A47H 1/022 211/105.4
2014/0374367 A1 * 12/2014 Morel ..... A47H 1/142 211/105.3
2020/0063774 A1 2/2020 Didehvar

FOREIGN PATENT DOCUMENTS

EP 2272404 A2 * 1/2011 ..... A47H 1/022
GB 2325397 A * 11/1998 ..... A47H 1/022

* cited by examiner

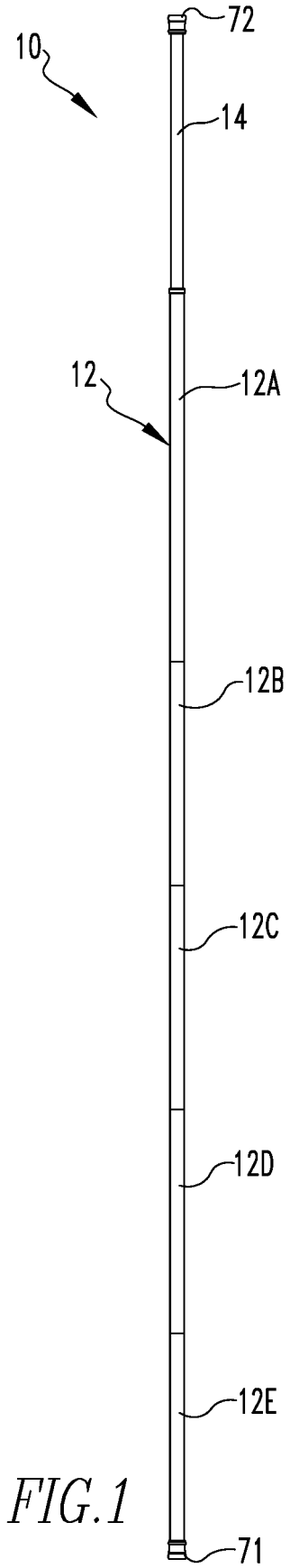
FIG.1
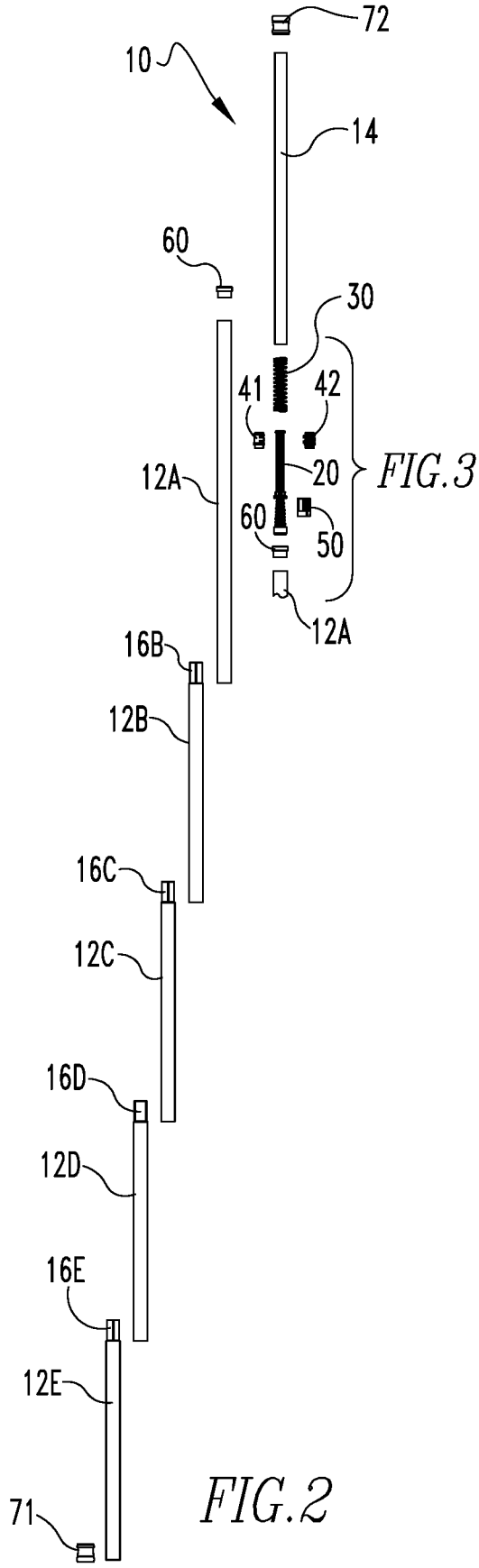
FIG.3
FIG.2

ADJUSTABLE TELESCOPING TENSION RODS

CROSS-REFERENCE TO RELATED APPLICATION

This application claims the benefit of U.S. Provisional Patent Application No. 63/118,455 filed Nov. 25, 2020, which is incorporated herein by reference.

FIELD OF THE INVENTION

The present invention relates to adjustable telescoping tension rods, and more particularly relates to mechanisms for adjusting the lengths of tension rods used for bathroom pole caddies, shower curtains, window curtains, and the like.

BACKGROUND INFORMATION

Spring-biased tension rods have been used for bathroom pole caddies and curtain rods. A need exists for adjusting the lengths of such tension rods to accommodate varying distances between opposing floor and ceiling surfaces, or between opposing wall surfaces, while maintaining sufficient tension force to hold the rods securely in place.

SUMMARY OF THE INVENTION

The present invention provides adjustable tension rods with spring-biased tension lock assemblies. The tension rods comprise at least one outer tube section and at least one inner tube section that are spring-biased with respect to each other by means of the tension lock assembly. The outer tube and/or inner tube may include a single tube section, or may include multiple tube sections that may be assembled together.

An aspect of the present invention is to provide an adjustable tension rod assembly comprising an outer tube, an inner tube telescopingly engageable in the outer tube, and a tension lock assembly attached to an end of the inner tube and insertable into an end of the outer tube. The tension lock assembly comprises a retaining rod comprising a spring retaining bar and a tapered threaded portion separated from each other along an axial length of the retaining rod by a mid separator flange, a spring surrounding at least a portion of the spring retaining bar having a first end contacting the mid separator flange, an anti-rotation collar surrounding a portion of the spring retaining bar fastened inside the end of the inner tube and having an end contacting a second end of the spring, wherein the anti-rotation collar is structured and arranged to substantially prevent rotation of the spring retaining bar around a longitudinal axis of the retaining rod and to allow relative axial movement of the retaining bar with respect to the anti-rotation collar along the longitudinal axis of the retaining rod, and a locking sleeve threadingly engaged with the threaded tapered portion of the retaining rod structured and arranged to radially expand outwardly when threaded from a narrow taper end of the threaded tapered portion toward a broad taper end of the threaded tapered portion to thereby force an outer sidewall of the locking sleeve against an inner wall of the outer tube to thereby releasingly lock the locking sleeve and retaining bar in a locked axial position along an axial length of the outer tube. In the locked axial position the outer tube and inner tube are axially movable with respect to each other along the axial length of the outer tube against a spring bias of the spring.

Another aspect of the present invention is to provide a telescoping rod assembly comprising an outer tube comprising multiple outer tube sections, an inner tube telescopingly engageable in a first end of a first one of the outer tube sections, a lock assembly structured and arranged to releasably lock the inner tube in the first outer tube section, and a reduced diameter end located at an end of a second one of the outer tube sections structured and arranged for removable insertion of the reduced diameter end into a second end of the first outer tube section.

These and other aspects of the present invention will be more apparent from the following description.

BRIEF DESCRIPTION OF THE DRAWINGS

FIG. 1 is a side view of an adjustable tension rod assembly in accordance with an embodiment of the present invention.

FIG. 2 is an exploded side view of the adjustable tension rod assembly of FIG. 1.

DETAILED DESCRIPTION

Figure 3:
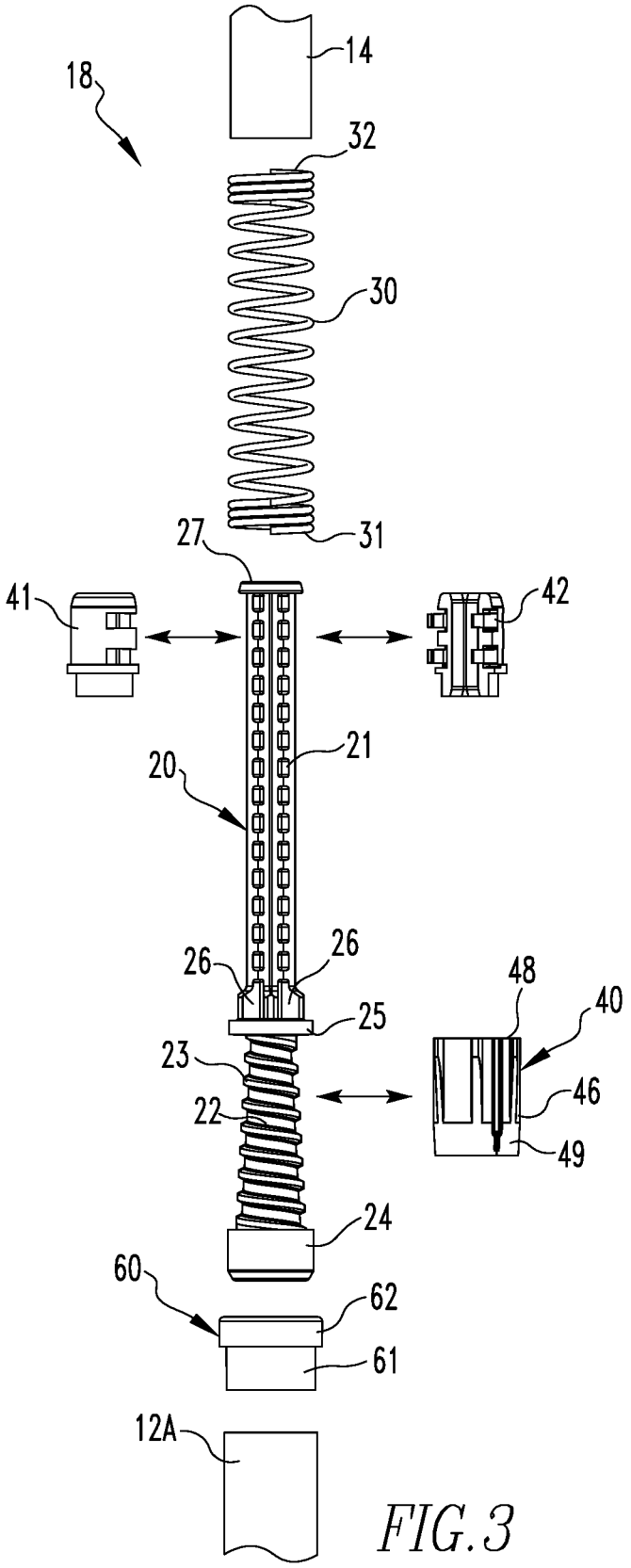
FIG. 3 is a magnified view of a portion of FIG. 2 showing a tension lock assembly in accordance with an embodiment of the present invention.

FIGS. 1 and 2 illustrates an adjustable tension rod assembly 10 of the present invention including an outer tube assembly 12 and an inner tube 14. In the embodiment shown, the outer tube assembly 12 includes multiple outer tube sections 12A, 12B, 12C, 12D and 12E. However, a single outer tube, or any other desired number of outer tube sections, may be used. As shown in FIGS. 2-8, the adjustable tension rod assembly 10 includes a tension lock assembly 18 for securing the outer tube assembly 12 and inner tube 14 together to provide an adjustable telescoping tension rod assembly in accordance with an embodiment of the present invention.

The tension lock assembly 18 includes a retaining rod 20 having a spring retaining bar 21 of non-circular cross section, a tapered threaded portion 22 having exterior threads 23, a tapered end cap 24, a mid separator flange 25, spring retaining webs 26, and a spring retaining bar end cap 27. The tapered threaded portion 22 is insertable in the outer tube 12, and the non-circular retaining bar 21 is insertable in the inner tube 14. The tension lock assembly 18 includes a spring 30 surrounding the spring retaining bar 21. The spring 30 has a first end 31 that fits over the spring retaining webs 26 and abuts the spring retaining bar end cap 27. The spring 30 has a second end 32 that abuts an anti-rotation collar 40, as more fully described below.

Figure 7:
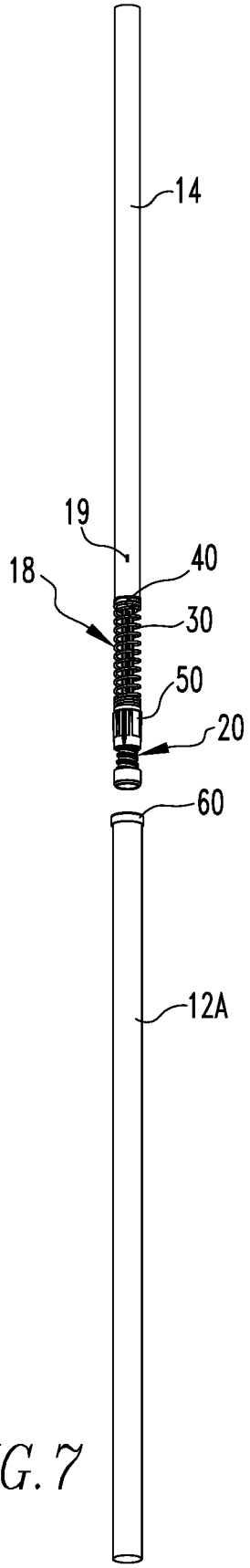
FIGS. 7 and 8 are side views illustrating a tension lock assembly of the present invention mounted at the end of an inner tube with a compression spring of the tension lock assembly extended in FIG. 7 and compressed in FIG. 8.
Figure 8:
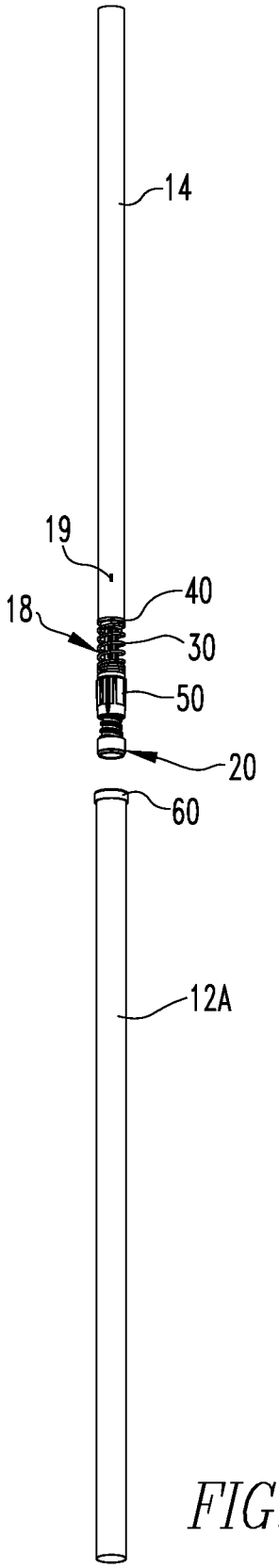
Figure 9:
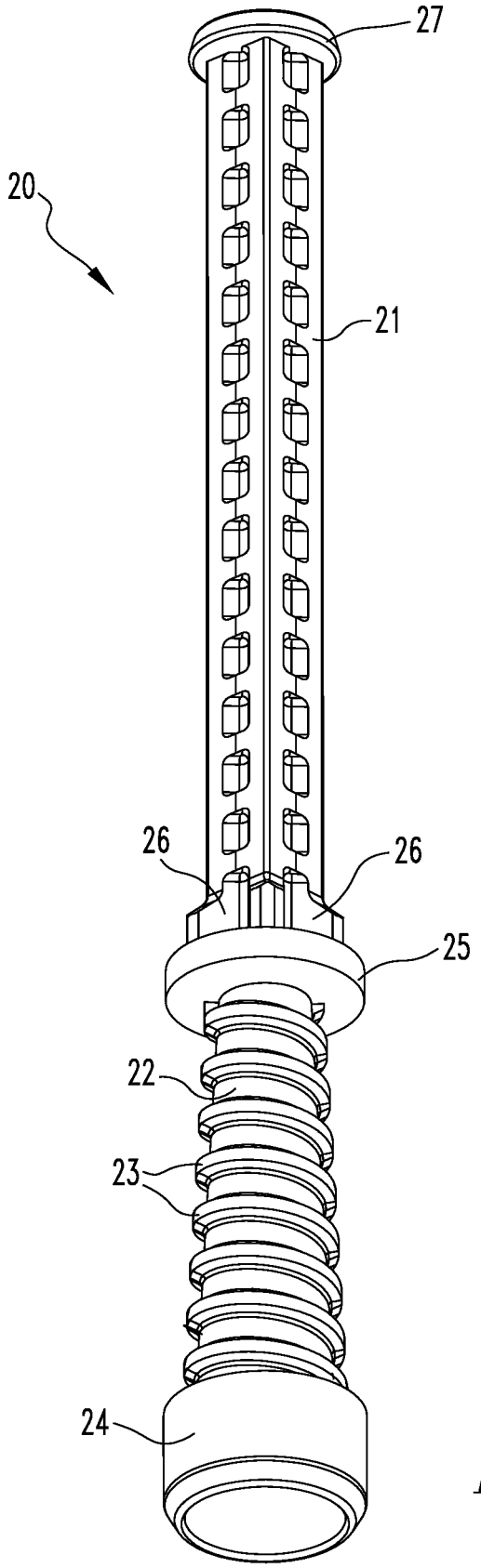
FIG. 9 is a side perspective view of a retaining rod for use in a tension lock assembly in accordance with an embodiment of the present invention.

As shown most clearly in FIGS. 3, 4, 6, 10 and 11, the anti-rotation collar 40 is inserted in the end of the inner tube 14. As shown in FIGS. 7 and 8, the anti-rotation collar 40 may be secured within the inner tube 14 by means of an indented dimple 19, or any other suitable fastening means such as crimping, press-fitting, mechanical fasteners and adhesives. The anti-rotation collar 40 has a generally cylindrical outer sidewall 46, an end flange 48 at one end and an insertion nose 49 at the opposite end from the end flange 48. A non-circular through hole 44 extends through the anti-rotation collar 40 in an axial direction of the collar. The anti-rotation collar 40 is secured in the end of the inner tube 14 to prevent relative rotational or axial movement. The non-circular through hole 44 of the anti-rotation collar 40 allows the non-circular spring retaining bar 21 to move axially within the inner tube 14, but prevents the spring retaining bar 21 and retaining rod 20 from rotating around the longitudinal axis of the inner tube 14. Although square cross-sections are shown in the figures for the non-circular retaining bar 21 of the spring retaining rod 20 and the non-circular hole 44 of the anti-rotation collar 40, any other suitable cross-sectional shape may be used that prevents relative rotation therebetween.

Figure 4:
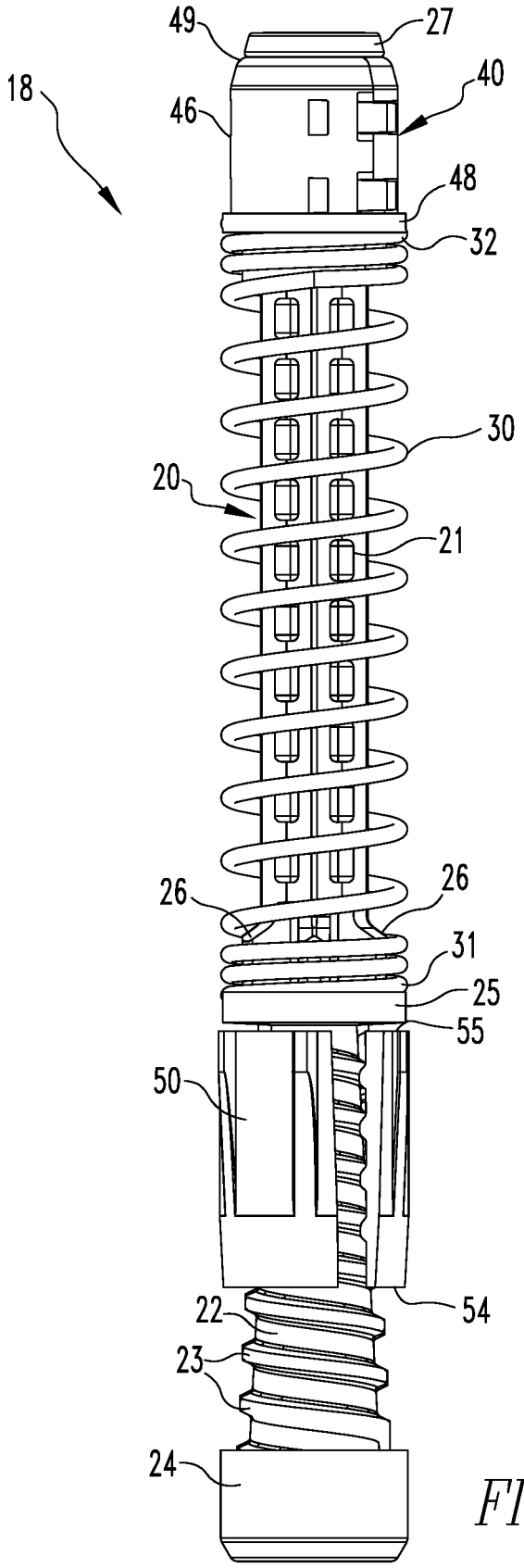
FIG. 4 is a side view of a tension lock assembly in accordance with an embodiment of the present invention.
Figure 5:
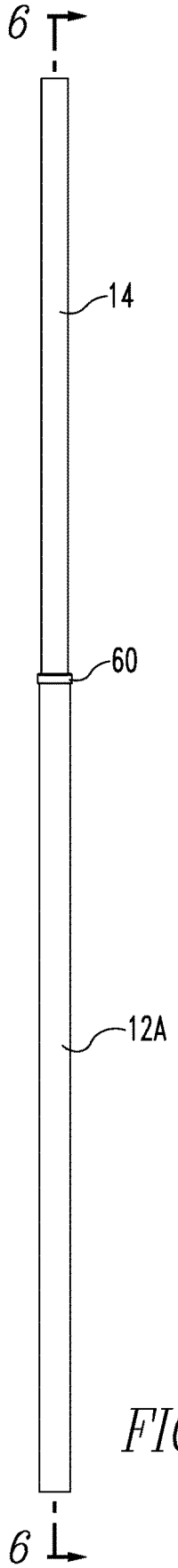
FIG. 5 is a side view illustrating a connection between an outer tube an inner tube in an adjustable tension rod assembly of the present invention.
Figure 6:
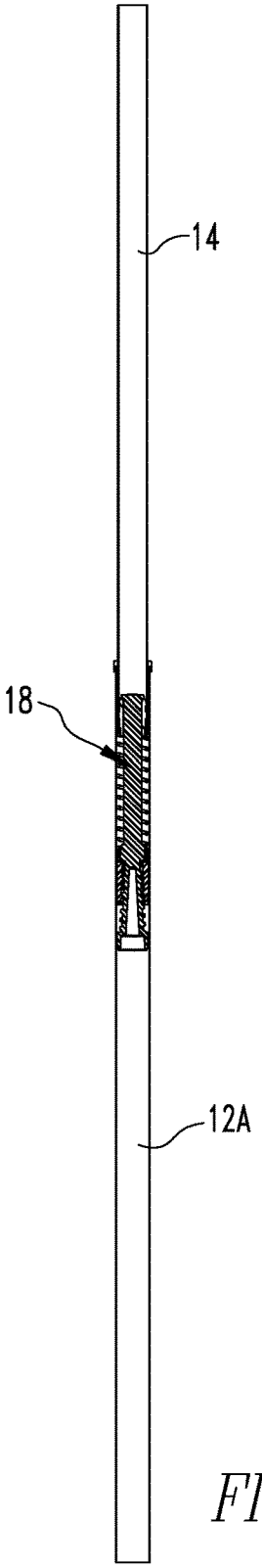
FIG. 6 is a side sectional view taken through section 6-6 of FIG. 5 showing a tension lock assembly of the present invention within the outer and inner tubes.
Figure 10:
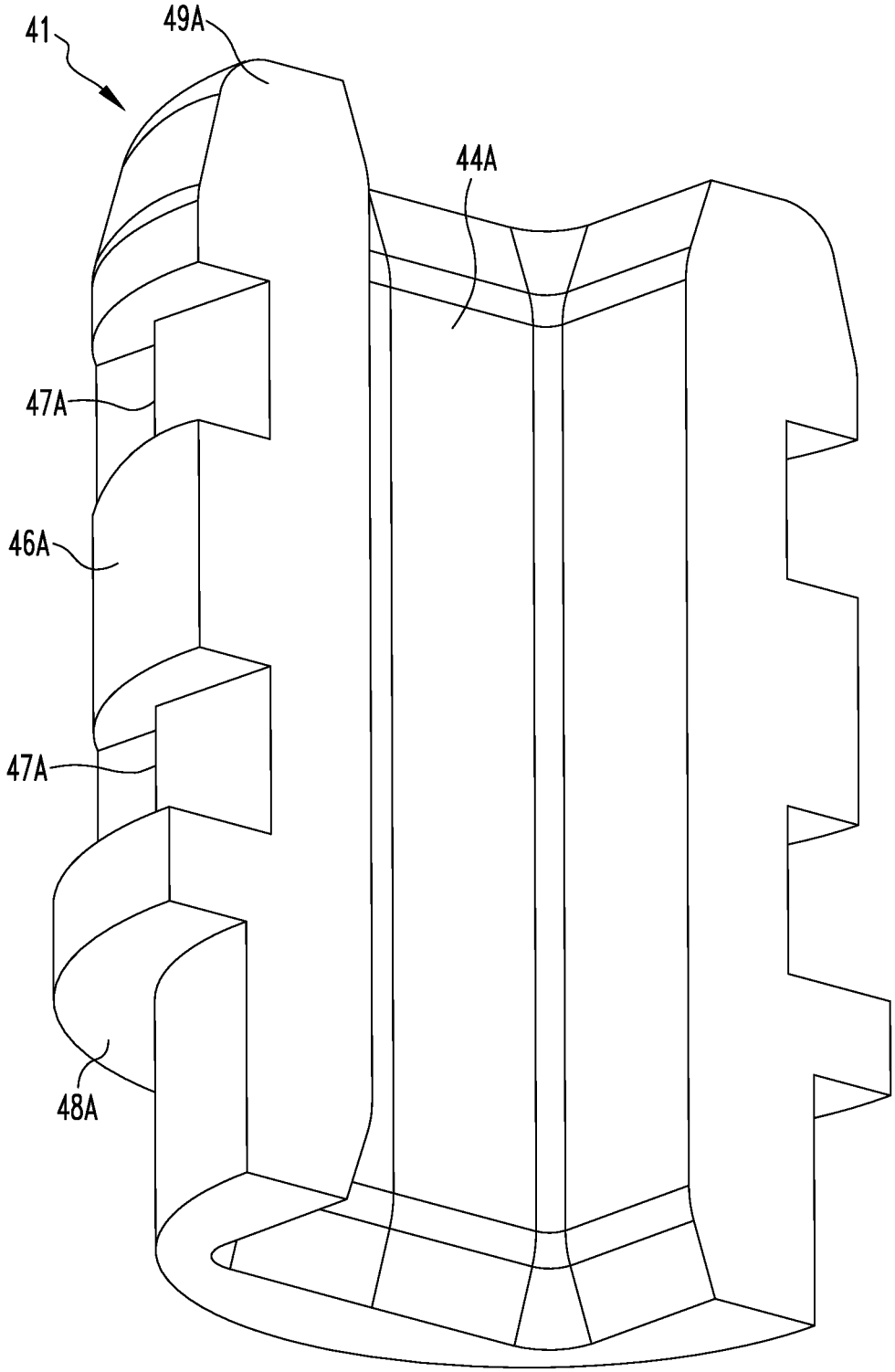
FIG. 10 is a side isometric view of one half of an anti-rotation collar for use in a tension lock assembly in accordance with an embodiment of the present invention.
Figure 11:
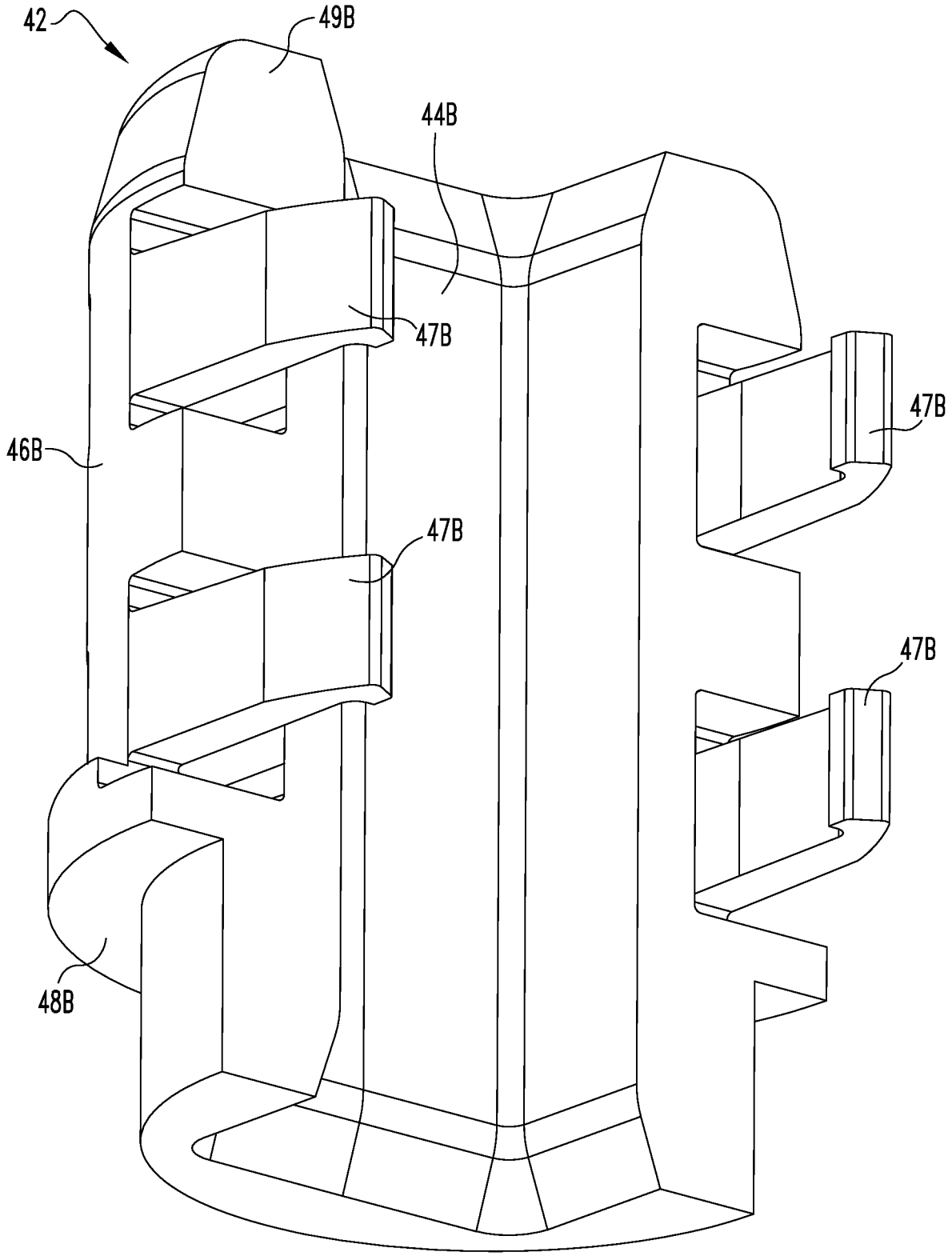
FIG. 11 is a side perspective view of another half of an anti-rotation collar for use in a tension lock assembly in accordance with an embodiment of the present invention.

As shown in FIGS. 3, 10 and 11, the anti-rotation collar 40 includes a first half 41 and a second half 42 that are secured around the spring retaining bar 21 adjacent to the spring retaining bar end cap 27 of the retaining rod 20. As shown in FIG. 10, the first half 41 of the anti-rotation collar 40 includes a first half 44A of the non-circular through hole 44, a first sidewall 46A forming half of the generally cylindrical outer sidewall 46, clip holders 47A, a first half 48A of the end flange, and a first half 49A of the insertion nose 49. As shown in FIG. 11, the second half 42 of the anti-rotation collar 40 includes a second half 44B of the non-circular through hole 44, a second sidewall 46B of the generally cylindrical outer sidewall 46, multiple clips 47B, a second half 48B of the end flange 48, and a second half 49B of the insertion nose 49. The clips 47B of the second half 42 of the anti-rotation collar 40 engage with the clip holders 47A of the first half 41 of the anti-rotation collar 40 to secure the first and second halves together, as shown in FIG. 4. With the anti-rotation collar 40 surrounding the spring retaining bar 21 of the retaining rod 20, the end flange 48 of the anti-rotation collar 40 abuts the second end 32 of the spring 30.

Figure 12:
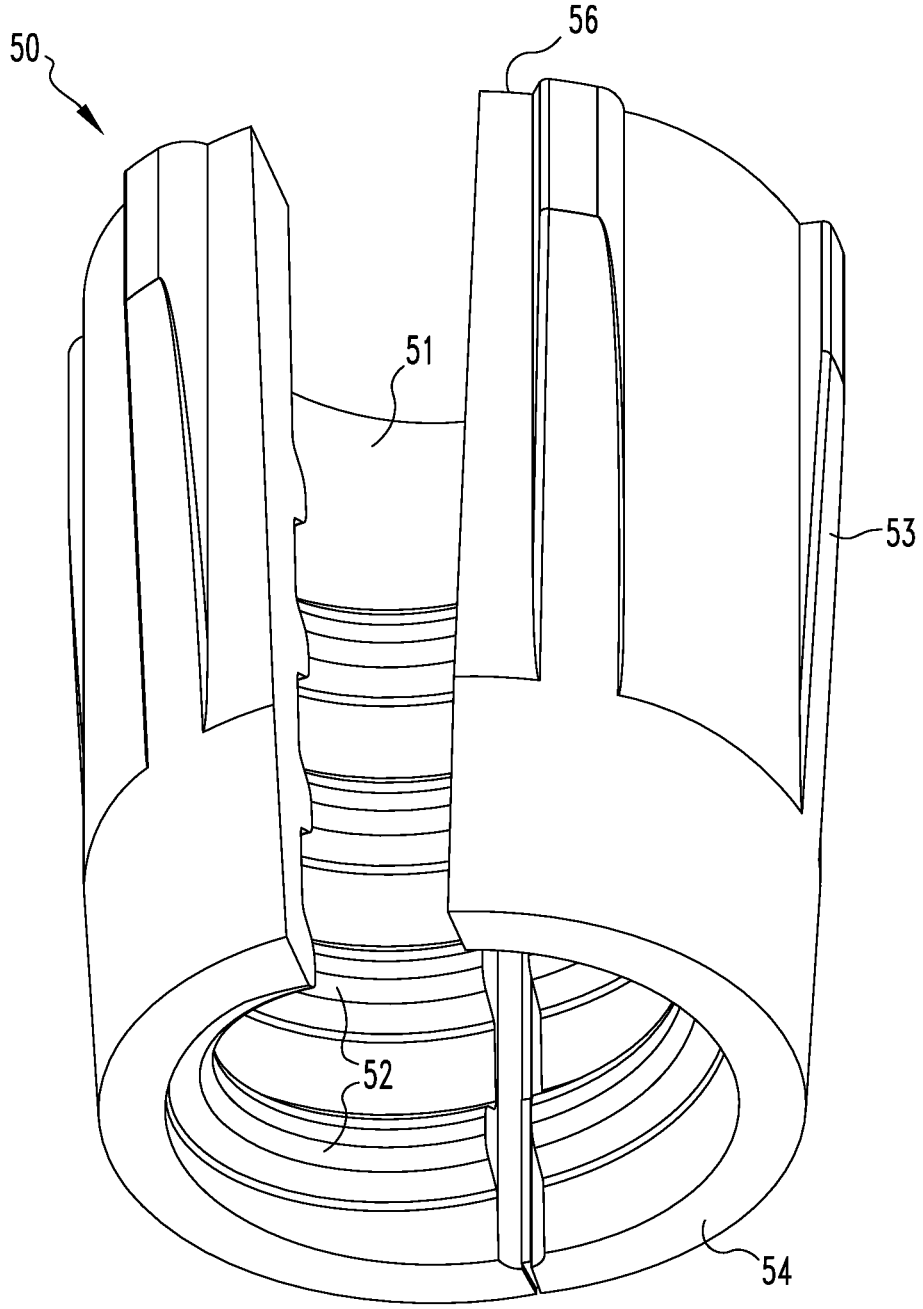
FIG. 12 is a side isometric view of a split locking sleeve for use in a tension lock assembly in accordance with an embodiment of the present invention.

As shown in FIGS. 3, 4 and 12, the split locking sleeve 50 includes a tapered interior opening 51, interior threads 52, a generally cylindrical outer sidewall 53, a first end 54 and, a second end 56. As shown most clearly in FIG. 4, the split locking sleeve 50 surrounds the tapered threaded portion 22 of the retaining rod 20. The interior threads 52 of the locking sleeve 50 engage the exterior threads 23 of the tapered threaded portion 22. The split locking sleeve 50 is threadingly movable along the axial length of the tapered threaded portion 22 between one position in which the first end 54 is adjacent to the tapered end cap 24 and another position in which the second end 55 is adjacent to the separator plate 25. When the split locking sleeve 50 is threaded toward the tapered end cap 24, its outer sidewall 53 expands radially outward to contact and press against an inner wall of the outer tube 12A. The tapered external threads of the spring-retaining rod 20 and the tapered internal threads of the split locking sleeve 50 engage with each other in a manner such that relative rotation of the outer and inner tubes 12 and 14 around their central longitudinal axis expands the outer diameter of the split cam nut 50 against the inner surface of the outer tube 12 to thereby releasably lock the spring-retaining rod 20 in a fixed axial position with respect to the outer tube 12.

With the outer tube 12 and retaining rod 20 locked together against relative axial movement, spring tension is still provided for the rod assembly 10 by allowing the spring-retaining rod 20 to slide axially within the non-circular hole 44 of the anti-rotation collar 40 and within the inner tube 14, against the force of the tension spring 30 as it is compressed between the mid separator flange 25 of the spring-retaining rod 20 and the opposing abutment end of the anti-rotation collar 40.

As shown in FIGS. 1-3 and 5-8, a protective end sleeve 60 is inserted in the end of the outer tube 12 in order to guide and protect the inner tube 14 as it telescopingly slides in the outer tube 12. The end sleeve 60 has a cylindrical body 61 and an end flange 62.

Figure 13:
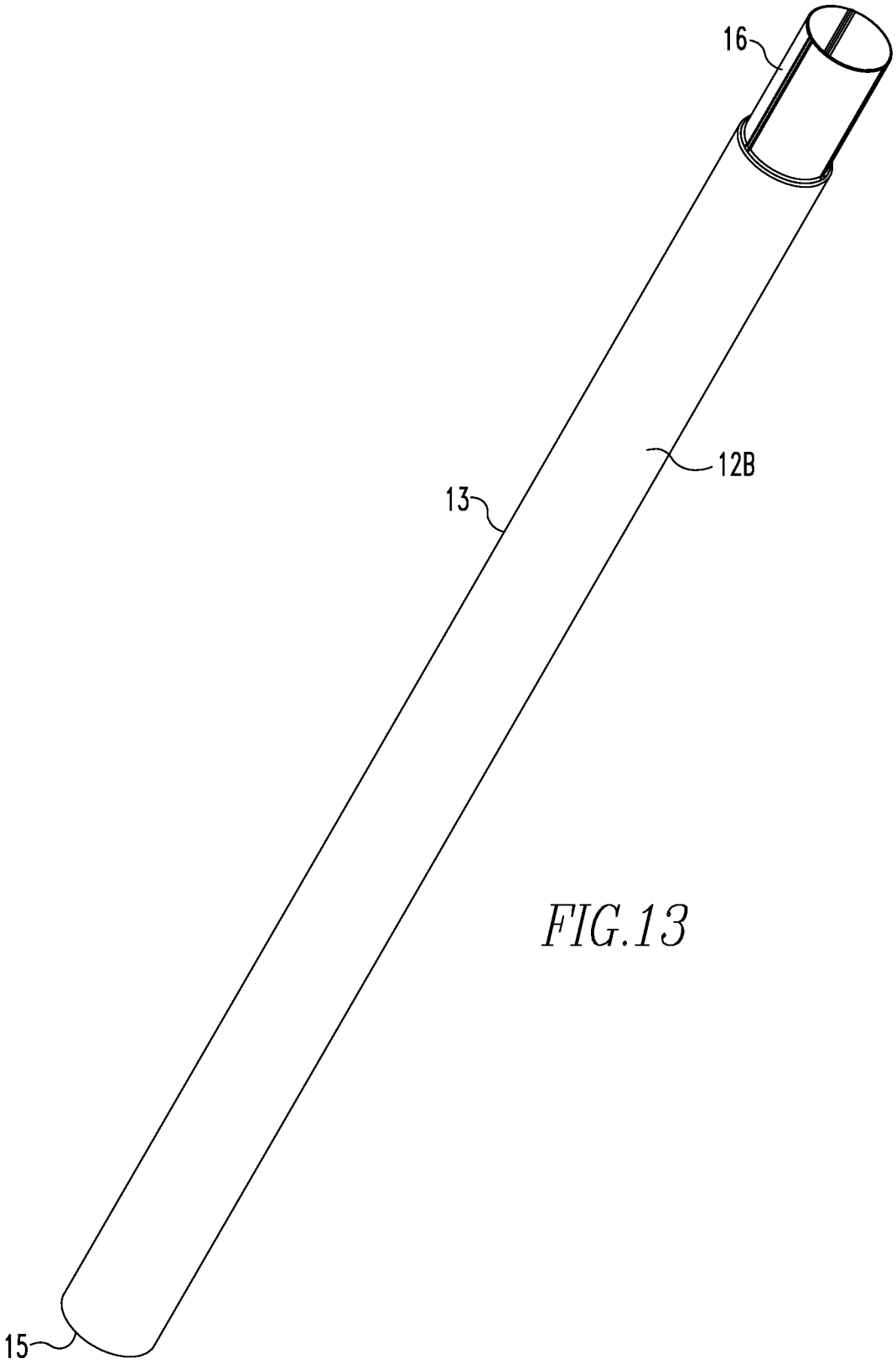
FIG. 13 is an isometric view of an outer tube assembly for use in rod assemblies of the present invention including an end having a reduced outer diameter for insertion into another tube section in accordance with an embodiment of the present invention.

FIG. 13 illustrates the second outer tube section 12B having a cylindrical outer tube sidewall 13. A first end 15 of the outer tube section 12B has an outer diameter corresponding to the outer diameter of the cylindrical sidewall 13. A second end 16 of the outer tube section 12B has a decreased outer diameter forming a connection insert 16 that may be inserted into the end of the first outer tube section 12A.

As shown in FIGS. 1, 2 and 13, the adjustable tension rod assembly 10 may be provided in the form of a multi-segment tube assembly in which two sections of the tubing include the first outer tube section 12A and inner tube 14, respectively, and additional tube sections 12B-E with narrowed or swaged ends are provided. The swaged end of each tube section 12B-E may be inserted and secured in a cylindrical non-swaged end of an adjacent tube section 12A-D to form the tube assembly. The lengths of the tube sections 12A-E may be the same or different from each other. For example, at least one of the swaged tube sections 12B-E may have a different length than the other swaged tube sections. Although four swaged tube sections are shown in FIGS. 1 and 2, any other suitable number of swaged tube sections may be used, e.g., from zero to 6 or more. The multi-segment adjustable tension rod assembly facilitates storage and shipping of the assemblies by decreasing the overall packaging lengths. Although the outer and inner tubes 12 and 14 are shown at one end of the multi-segment adjustable tension rod assembly in FIGS. 1 and 2, any other suitable arrangement may be used, for example, the outer and inner tubes 12 and 14 and associated tension mechanism 18 may be provided at either end of the multi-segment adjustable tension rod assembly, or may be provided in the middle of the assembly with one or more additional tube section(s) removably attached to the end of the outer and/or inner tube. Although the ends of selected tube sections are swaged or narrowed in the embodiment shown in FIG. 10, any other suitable attachment means may be used, such as radially extending retractable pins and radial pin-receiving holes at the ends of adjoining tube sections, and the like.

Multi-segment tube assemblies, such as the tube sections with swaged ends described above, may be used with any other suitable rod and pole configurations to decrease packaging lengths. For example, the multi-segment tube assemblies may be incorporated into extendable rod and pole assemblies such as disclosed in U.S. Pat. Nos. 8,827,587 and 8,960,456, and Published U.S. Patent Application Nos. 2012/0005823; 2013/0112639; 2013/0334156; and 2014/0166603, all of which are incorporated herein by reference.

The adjustable tension rod assemblies 10 of the present invention may include first and second end caps, such as first and second end caps 71 and 72 shown in FIGS. 1 and 2.

The components of the adjustable tension rod assemblies 10 of the present invention may be made from any suitable materials. For example, the outer and inner tubes 12 and 14 and any additional swaged or narrowed tube segments may be made of metal such as steel, aluminum and the like, or polymeric materials such as high-density polyethylene (HDPE) and the like. The spring-retaining rod 20, split anti-rotation collar 40 and end sleeve 60 may be made of metal or polymeric materials such as nylon, HDPE, polycarbonate, polystyrene, polypropylene, acrylonitrile butadiene styrene (ABS), styrene acrylonitrile (SAN), polyurethane, polyvinyl chloride (PVC), rubber and the like. The tension spring 30 may be made of steel and the like. The split locking sleeve 50 may be made of polymers such as polyurethane, thermoplastic polyurethane (TPU), polycarbonate, polystyrene, polypropylene, ABS, SAN, PVC and the like, or synthetic or natural rubber having a relatively low durometer.

The adjustable tension rod assemblies 10 of the present invention may be easily installed between opposing ceiling and floor surfaces, or between opposing wall surfaces, by sliding the inner tube 14 out from the outer tube 12 until the total length of the assembly 10 is slightly larger than the distance between the opposing surfaces, for example, from 0.5 to 4 inches larger, from 1 to 3 inches larger, or from 1.5 to 2.5 inches larger. The outer and inner tubes 12 and 14 are then twisted relative to each other around their longitudinal axis to thereby expand the outer diameter of the split locking sleeve 50 against the inner surface of the outer tube 12, and to releasably lock the spring-retaining rod 20 in a fixed axial position with respect to the outer tube 12. The assembly 10 is then installed between the opposing surfaces by compression of the spring 30. In the installed position, spring tension holds the assembly 10 in place.

The following examples are intended to illustrate various aspects of the present invention, and are not intended to limit the scope of the invention.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. An adjustable tension rod assembly comprising:

an outer tube;

an inner tube telescopingly engageable in the outer tube; and a tension lock assembly attached to an end of the inner tube and insertable into an end of the outer tube, comprising:

a retaining rod comprising a spring retaining bar and a tapered threaded portion separated from each other along an axial length of the retaining rod by a mid separator flange;

a spring surrounding at least a portion of the spring retaining bar having a first end contacting the mid separator flange;

an anti-rotation collar surrounding a portion of the spring retaining bar fastened inside the end of the inner tube and having an end contacting a second end of the spring, wherein the anti-rotation collar comprises a first half and a second half connectable to each other to surround the portion of the spring retaining bar and is structured and arranged to substantially prevent rotation of the spring retaining bar around a longitudinal axis of the retaining rod and to allow relative axial movement of the retaining bar with respect to the anti-rotation collar along the longitudinal axis of the retaining rod; and a locking sleeve threadingly engaged with the threaded tapered portion of the retaining rod structured and arranged to radially expand outwardly when threaded from a narrow taper end of the threaded tapered portion toward a broad taper end of the threaded tapered portion to thereby force an outer sidewall of the locking sleeve against an inner wall of the outer tube to thereby releasingly lock the locking sleeve and retaining bar in a locked axial position along an axial length of the outer tube, wherein in the locked axial position the outer tube and inner tube are axially movable with respect to each other along the axial length of the outer tube against a spring bias of the spring.

2. The adjustable tension rod assembly of claim 1, wherein the first and second halves of the anti-rotation collar form a non-circular through hole extending through the anti-rotation collar along a longitudinal axis of the anti-rotation collar that slidingly receives the spring retaining bar of the retaining rod.

3. The adjustable tension rod assembly of claim 2, wherein the first half of the anti-rotation collar comprises a first outer sidewall having a first generally cylindrical section, the second half of the anti-rotation collar comprises a second outer sidewall having a second generally cylindrical section, and the first and second generally cylindrical sections form a generally cylindrical outer sidewall of the anti-rotation collar.

4. The adjustable tension rod assembly of claim 1, wherein the anti-rotation collar comprises a non-circular through hole extending through the anti-rotation collar along a longitudinal axis of the anti-rotation collar that slidingly receives the spring retaining bar of the retaining rod.

5. The adjustable tension rod assembly of claim 4, wherein the non-circular through hole has a substantially square cross-section and the spring retaining bar has a substantially square cross-section.

6. The adjustable tension rod assembly of claim 1, wherein the spring retaining bar comprises a spring retaining bar end cap engageable with the anti-rotation collar structured and arranged to prevent the spring retaining bar from being axially removed from the anti-rotation collar.

7. The adjustable tension rod assembly of claim 1, further comprising at least one spring retaining web adjacent the mid separator flange and spring retaining bar, wherein the at least one spring retaining web contacts the first end of the spring to thereby prevent the first end of the spring from moving in a radial direction perpendicular to the longitudinal axis of the retaining rod.

8. The adjustable tension rod assembly of claim 1, wherein the end of the anti-rotation collar contacting the second end of the spring comprises a cylindrical portion structured and arranged to prevent the second end of the spring from moving in a radial direction perpendicular to the longitudinal axis of the retaining rod.

9. The adjustable tension rod assembly of claim 8, further comprising a radially extending end flange adjacent the cylindrical portion of the end of the anti-rotation collar that contacts the second end of the spring.

10. The adjustable tension rod assembly of claim 1, further comprising a tapered end cap adjacent the tapered threaded portion of the retaining rod comprising a substantially cylindrical radial outer surface structured and arranged to be slidingly movable within the outer tube.

11. The adjustable tension rod assembly of claim 10, wherein the tapered threaded portion of the retaining rod tapers outwardly toward the tapered end cap.

12. The adjustable tension rod assembly of claim 1, wherein the locking sleeve comprises a tapered interior opening comprising interior threads that are threadingly engaged with exterior threads of the tapered threaded portion of the retaining rod.

13. The adjustable tension rod assembly of claim 1, wherein the outer tube comprises a single outer tube section.

14. The adjustable tension rod assembly of claim 1, wherein the outer tube comprises multiple outer tube sections removably attachable to each other.

15. The adjustable tension rod assembly of claim 14, wherein at least one of the outer tube sections comprises a reduced diameter end structured and arranged for removable insertion into an end of another one of the outer tube sections.

16. A telescoping rod assembly comprising:

an outer tube comprising multiple outer tube sections;

an inner tube telescopingly engageable in a first end of a first one of the outer tube sections;

a lock assembly structured and arranged to releasably lock the inner tube in the first outer tube section; and a reduced diameter end located at an end of a second one of the outer tube sections structured and arranged for removable insertion of the reduced diameter end into a second end of the first outer tube section, wherein the lock assembly comprises a tension lock assembly attached to an end of the inner tube and insertable into an end of the outer tube, the tension lock assembly comprising:

a retaining rod comprising a spring retaining bar and a tapered threaded portion separated from each other along an axial length of the retaining rod by a mid separator flange;

a spring surrounding at least a portion of the spring retaining bar having a first end contacting the mid separator flange;

an anti-rotation collar surrounding a portion of the spring retaining bar fastened inside the end of the inner tube and having an end contacting a second end of the spring, wherein the anti-rotation collar comprises a first half and a second half connectable to each other to surround the portion of the spring retaining bar and is structured and arranged to substantially prevent rotation of the spring retaining bar around a longitudinal axis of the retaining rod and to allow relative axial movement of the retaining bar with respect to the anti-rotation collar along the longitudinal axis of the retaining rod; and a locking sleeve threadingly engaged with the threaded tapered portion of the retaining rod structured and arranged to radially expand outwardly when threaded from a narrow taper end of the threaded tapered portion toward a broad taper end of the threaded tapered portion to thereby force an outer sidewall of the locking sleeve against an inner wall of the outer tube to thereby releasingly lock the locking sleeve and retaining bar in a locked axial position along an axial length of the outer tube, wherein in the locked axial position the outer tube and inner tube are axially movable with respect to each other along the axial length of the outer tube against a spring bias of the spring.

* * * * *